US005611629A

United States Patent [19]

Paranjpe

[11] Patent Number: 5,611,629

[45] Date of Patent: Mar. 18, 1997

[54] MULTIPLE PRINT HEAD NONIMPACT PRINTING APPARATUS

[76] Inventor: Suresh C. Paranjpe, 2105 Ridge Pointe Dr., Lake Oswego, Oreg. 97034

[21] Appl. No.: 300,698

[22] Filed: Sep. 2, 1994

Related U.S. Application Data

[63] Continuation of Ser. No. 57,538, May 4, 1993, abandoned, which is a continuation-in-part of Ser. No. 47,144, Apr. 12, 1993, which is a continuation-in-part of Ser. No. 39,871, Mar. 30, 1993, Pat. No. 5,445,463.

[51] Int. Cl.[6] ..... B41J 3/54

[52] U.S. Cl. ..... 400/82; 400/120.02; 347/172

[58] Field of Search ..... 400/240, 241, 400/120.01, 206, 82, 120.02, 120.03, 120.04; 347/171, 172, 173, 174, 175, 176

[56] References Cited

U.S. PATENT DOCUMENTS

| | | | |
|---|---|---|---|
| 4,408,212 | 10/1983 | Moriguchi et al. | 346/46 |
| 4,462,704 | 7/1984 | Kurata et al. | 346/76 PH |
| 4,613,245 | 9/1986 | Ikeda et al. | 400/328 |
| 4,714,363 | 12/1987 | Minowa | 400/328 |
| 4,815,872 | 3/1989 | Nagashima | 400/240 |
| 4,863,297 | 9/1989 | Fujii | 400/249 |
| 4,970,531 | 11/1990 | Shimizu et al. | 400/249 |
| 5,066,151 | 11/1991 | Durr et al. | 400/605 |
| 5,089,831 | 2/1992 | Ito et al. | 400/120 |
| 5,116,148 | 5/1992 | Ohara et al. | 400/241 |
| 5,167,456 | 12/1992 | Murakoshi et al. | 400/82 |

FOREIGN PATENT DOCUMENTS

| | | | |
|---|---|---|---|
| 565775 | 1/1981 | Japan | 400/149 |
| 6076377 | 4/1985 | Japan | 400/120 MC |
| 0126483 | 1/1989 | Japan | 400/120 MC |

*Primary Examiner*—Ren Yan

*Attorney, Agent, or Firm*—Marger, Johnson, McCollom & Stolowitz, P.C.

[57] ABSTRACT

A non-impact type of printer includes multiple ribbons and multiple printer heads so as to allow use of different types of printing technologies without requiring a user to manually change ribbons. In one embodiment, one of the ribbons installed in the printer comprises ordinary thermal transfer material while another ribbon provides a dye-diffusion type of transfer material. Installation of these and other types of ribbons in a single printer provides reduced cost and is more convenient and flexible than changing ribbons or selecting separate printers as needed.

7 Claims, 7 Drawing Sheets

MULTIPLE PRINT HEAD NONIMPACT PRINTING APPARATUS

This is a continuation of application Ser. No. 08/057,538 filed May 4, 1993, now abandoned, which is a continuation-in-part of application Ser. No. 08/047,144, filed Apr. 12, 1993, which is a continuation-in-part of application Ser. No. 08/039,871 filed Mar. 30, 1993, now U.S. Pat. No. 5,445,463.

BACKGROUND OF THE INVENTION

1. Field of the Invention

This invention relates to an image forming apparatus or nonimpact printer that uses an ink or dye ribbon and a form of energy to cause the transfer of a selected portion of ink or dye to a substrate to form an image, and particularly to such printers that are capable, e.g., of carrying out both thermal transfer and dye diffusion printing. Specifically, the invention relates to a printer in which separate print heads, ribbons and image transfer mechanisms are provided to permit multiple image transfers onto a substrate that remains held throughout to help ensure accurate image registration.

2. Background Information

In thermal transfer printing, an ink- or dye-bearing ribbon is pressed against a substrate between the thermal print head and a platen. The substrate can be ordinary or specially coated paper, or also plastic film, acetate and the like. Resistor elements in the print head are selectively subjected to a heating current to cause the transfer of ink or dye from the ribbon to the substrate in a desired pattern. In the analogous elecroresistive printing process, the print head incorporates needle-like electrodes that are selectively brought into contact with an electroresistive ribbon layer to cause an electrical current to pass therethrough, through an underlying electrically conductive layer, and thence back to a return electrode placed against the electroresistive layer. Variously colored heat sensitive ink layers are disposed on the side of the conductive layer opposite the electroresistive layer, and the heat generated within the electroresistive layer passes through the conductive layer to cause softening or melting and thus transfer of the ink in the ink layer to the substrate in a desired pattern. In dye diffusion printing, the diffusion or sublimation of dye from the ribbon to the substrate is employed instead of melting ink. There also exist direct energy processes, and other image transfer mechanisms employ combinations of chromogenic materials and encapsulated radiation curable composition, combinations of a developer and a photosensitive microencapsulated material, materials subject to transfer when acted upon by light, and materials in which a combination of light and heat will bring about changes in such physical parameters of said materials as viscosity or various softening, melting and glass transition temperature.

For black printing, a single black ink or dye panel can be used, and a single ribbon might include a multiplicity of black panels, each of the same size (e.g., letter, legal size, A-4 or A-5, etc.) as the substrate onto which the image is to be transferred. For color printing, generally thee separate color panels in the colors yellow, magenta, and cyan are used, and these panels will typically be angled in repetitive units along the ribbon. A full color image is formed from the three primary colors by printing one over the other, typically in the order yellow, magenta and cyan.

The three colors can also be superimposed to produce a black image, but such an image will not be of the same quality as is produced using a single black ink or dye. To use three color panels to produce a black image is also wasteful of color panels, and significantly increases the time required for the image transfer. To obtain the higher quality black image available from a black ribbon has hitherto required replacement of the three-color ribbon with a black ribbon, hence to avoid such repetitive ribbon changing, ribbons have been devised that include black panels in addition to the thee color panels. Also, the present applicant's U.S. patent application Ser. No. 08/039,871 filed Mar. 30, 1993 entitled COMBINATION INK OR DYE RIBBON AND APPARATUS FOR NONIMPACT PRINTING describes "combination ribbons" which, in addition to three-color and black panels, also include different types of panels, e.g., both thermal transfer and dye diffusion, that may be used for different printing requirements. It thus becomes possible to carry out various kinds of printing using just one ribbon.

One disadvantage of the foregoing procedure, however, is that of needing to traverse through the ribbon in order to arrive at a black ink panel, move back again to carry out color printing, then go back to the black panel, or to another panel type, and so on. Such a process is wasteful of time and can ultimately be damaging to the ribbon. Moreover, the relative amounts of full color and black or other printing (e.g., thermal transfer and dye diffusion) required may not coincide with the relative numbers of different panel colors or types on the ribbon, so that some portions of the ribbon may become wasted.

Another disadvantage of the "combination ribbon" approach of U.S. Pat. application Ser. No. 08/039,871 filed Mar. 30, 1993 noted above is that thermal transfer and dye diffusion printing are generally employed for different purposes. For example, conventional thermal transfer processes, while less restrictive than dye diffusion in terms of the nature of the substrate, do not produce the true continuous tone images that can be obtained using dye diffusion, and it would be difficult to estimate in advance, in developing a ribbon to be used for both of those processes, the relative numbers of ink and dye panels to include on the ribbon. More recent thermal transfer techniques that incorporate variable dot size provide higher quality, but require special ribbons and print heads. It is preferable, therefore, to provide a printer in which the thermal transfer (conventional or more recent) and dye diffusion processes are carried out using different ribbons, each designed for use in just one of those two processes. Of course, if electroresistive printing is also to be employed, that process must likewise have a ribbon therefor. It may also be desired, of course, to provide means for direct energy printing in which no ribbon is employed.

One solution of the foregoing problem has been to employ two printers: one having a three-color ribbon for full color printing, and other a totally black ink ribbon for printing in black. However, that process introduces extra expense, and also requires additional desk space. Moreover, for images that require black printing along with full color printing, to obtain the higher quality black image form the black ink printer it becomes necessary to transfer the substrate onto which the image is to be placed from one printer to the other, and it may be difficult or impossible to obtain the same positioning of the substrate in the one printer as the other, so that the image transferred in the second printing will appear where desired relative to the first image. The alternative procedure of using just one printer but changing ribbons for each kind of printing process, while saving of expense and desk space, introduces even greater operator inconvenience.

In the copier art, U.S. Pat. No. 4,783,681 issued Nov. 8, 1988 to Tanaka et al, describes a system that includes a plurality of copier units, each of which will record an image on a separate recording material when used alone, but when the units are coupled together a single material can receive a first image from a first copier unit and then be transported to a second unit to receive a second, overlaid image, and so on. The plurality of identical recording units are designed to plug one into the other so that recording material can be passed therebetween, and control of such a sequence of recording units is then carried out from the first unit in the sequence. Registration between successive images is controlled firstly by using sheet discharging means within a sheet transferring unit to place a sheet of image-receiving material into the next unit in the sequence, and secondly by transmitting from the transferring unit to that next receiving unit a timing signal to control the registration rollers of the latter unit. Although this Tanaka et al. patent does address the multi-image registration problem noted above, it does not address the transfer of images either by direct energy or by using a transfer material disposed on a ribbon.

Another type of thermal transfer printer employs a back roller instead of a platen such that the back roller faces against the thermal head with the ink donor sheet or ribbon and the recording sheet or receiving medium pressed therebetween as usual, wherein the back roller is driven by a motor so as to advance both the ribbon and receiving medium. U.S. Pat. No. 4,495,507 issued Jan. 22, 1985 to Moriguchi et al. describes such a device that contains two complete "recording stations," i.e, two separately functioning back rollers, back roller drive motors, thermal heads, and ribbons (on associated supply and takeup rolls) wherein the two ribbons provide two-color printing onto a receiving medium that is made to pass first through one recording station and then through the other. This particular "two-station" design has its own type of registration problem, namely, that any difference in diameter between the two back rollers will cause differences in the rate of advance of the receiving medium in the two cases, thereby introducing a color shift in the transferred image. The Moriguchi et al, '507 patent seeks to resolve that problem by using different roller drive motors so that one motor can compensate for such variations in the rate of medium advance.

In two-station printing, it had also been the practice for the image data for the second station in line to be stored in memory, to be released at a time determined by the distance between printing stations and the rate of movement of the ribbon and substrate. Because of the distance of separation required between the two thermal heads in such a linear design, however, the amount of memory required for such data storage came to be a problem, hence a variant of the Moriguchi et al. '507 device, found in U.S. Pat. No. 4,385,302 issued May 24, 1983 to Moriguchi et al., employs a plurality of thermal head assemblies arranged radially around a single backing roller. In a linear, three-station embodiment, synchronization between the image-forming processes is achieved by way of synchronization marks that, along with the first image transfer (e.g., a yellow color transfer), are placed by the first thermal head along one edge of the substrate and are then read by first and second marker sensors associated respectively with second and third thermal head assemblies. In U.S. Pat. No. 4,408,212 issued Oct. 4, 1983 to Moriguchi et al., positional displacement between images in a two- or multiple-head device is avoided by means of a belt that extends around adjacent rollers in contact with the substrate upon which such images are placed so as to eliminate positioning errors arising from any differences in the diameters of such rollers. U.S. Pat. No. 4,410,897 issued Oct. 18, 1983 to Moriguchi et al. describes two separate recording stations of the back roller type that are disposed on opposite sides of the substrate onto which the image is to be transferred so as to permit printing on both sides of the substrate in a single pass.

U.S. Pat. No. 4,462,704 issued Jul. 31, 1984 to Karata et al. sets forth pulse generator means that operate from a single power source for driving a plurality of thermal print heads in the Moriguchi et al. '897 configuration. Similarly, U.S. Pat. No. 4,811,036 issued Mar. 7, 1989 to Gaskill et al. describes two separate printing means, e.g., conventional thermal print heads using separate platens and printing films (i.e., ribbons), disposed on opposite sides of a continuous strip and controlled in such a way that the longitudinal positioning of the images produced by the two thermal print heads on the opposite sides of the continuous strip are coordinated.

U.S. Pat. No. 4,595,303 issued Jun. 7, 1986 to Kuzuya et al. describes a printing apparatus including two assemblies in which one provides character type elements and the other produces characters using a dot matrix. U.S. Pat. No. 4,863,297 issued Sep. 5, 1989 to Fujii describes a thermal printer having three thermal heads, each of which is disposed to transfer ink from a separate colored ribbon. It is not possible from any of these constructions, however, to provide all of the fundamentally different types of printing, i.e., thermal transfer, dye diffusion, and electroresistive, that may be needed in the more modern printing environment.

U.S. Pat. No. 4,815,872 issued Mar. 28, 1989 to Nagashima seeks to describe apparatus having two print heads and associated ribbons and platens: one print head is used conventionally for multicolor printing, and a second print head for which the associated ribbon contains only transparent ink serves to print a protective layer over the multicolor image. This patent thus does not explicitly address the aforesaid registration problems.

Some of the problems remaining within the foregoing art have been addressed by this applicant's application Ser. No. 08/047,144 filed Apr. 12, 1993. Specifically, although application Ser. No. 08/039,871 filed Mar. 30, 1993 made possible the use of various technologies within a single printer by way of "combined ribbons" and multiple printing devices, in application Ser. No. 08/047,144 filed Apr. 12, 1993 is still remained necessary, in order to carry out those different technologies, to move the substrate from one printing location to another. That is, in any of the embodiments of the device described in application Ser. No. 08/047,144 filed Apr. 12, 1993 that have two different print heads that can be placed individually into cooperation with one and the same ribbon/printing system, there is available within a single such system only a single ribbon. Whatever type of printing may be desired must then be provided either (1) by way of panels that are incorporated within that system; or (2) by moving the substrate to a different ribbon/printing location, thereby introducing possible registration errors (even though such errors are indeed minimized by use of the belt and clamp mechanism shown in FIG. 7 of application Ser. No. 08/047,144 filed Apr. 12, 1993). Although the two aforesaid patent applications taken together provide means for a very wide variety of printing tasks, some of the print head/ribbon combinations that would be required may be limited in scope: if but a single printing location is to be used to avoid registration errors, the single ribbon associated with that one location may become very specialized. What is needed and would be useful, therefore, is a means for conducting in a consistent way various multiple image printing tasks wherein the substrate need not be moved between printing locations, and indeed for reasons of printing speed, wherein more than one printing process can be carried out at once. Accuracy of registration between images will thus be limited only by the printing process itself, and not by having been required to move the image-receiving substrate after having completed one printing task so as to commence another. Although at the expense of providing one or more additional print heads, that capability is provided by the present invention in which multiple ribbons and associated energy sources for image transfer are able to carry out successive printing operations on a substrate that has remained held throughout.

TERMINOLOGY

The invention in its several aspects encompasses a wide range of applications, for which the use of particular terminology seems appropriate. When used hereinafter, therefore, unless otherwise indicated the following terms will have the meanings stated:

Energy Source:

A source of a form of energy (heat or light), including a laser, a conventional thermal transfer print head, and the like.

Transfer material:

A substance placed on a medium for the purpose of being transferred therefrom to a substrate by the application thereto of one or more forms of energy in order to form an image on the substrate, either directly or indirectly.

Printer:

An apparatus that uses an energy source to apply one or more forms of energy either to a transfer material or to a substrate so as to form an image on the substrate, including a printer, a facsimile machine (FAX), the printing portion of a copier, or the printing portion of any other device that functions as stated.

Direct Energy:

A method of forming an image in which one or more forms of energy are applied directly to a substrate on which the image is to be formed. The energy elicits some change in the material of the substrate so as to form the image either from that energy alone, or following passage of the substrate through a hot roll process or the like.

Technology:

A particular method of transferring an image from a medium to a substrate using one or more forms of energy, including those in which the transfer material comprises thermal transfer ink, dye diffusion dye, electroresistive ink, combinations of chromogenic materials and encapsulated radiation curable compositions, combinations of a developer and a photosensitive microencapsulated material, materials subject to transfer when acted upon by light (including laser light), and materials in which both light and heat bring about changes in at least one of the group of physical parameters of said materials consisting of softening, melting and glass transition temperatures, and of viscosity. The term also encompasses developing an image by direct energy processes, as well as other methods and materials whether or not presently known or conceived.

Type:

Variations in method within a particular technology, such as the use of different thermal transfer materials that require different temperatures or the like for transfer to occur.

Class:

A subset of transfer materials within a particular technology, e.g., precoat, overcoat and colored ink comprise three classes of thermal transfer materials.

Panel:

A single continuous region on a substrate that has had a single class of transfer material, and in a single color (where applicable), applied thereon.

Set:

A collection of one or more panels that are contiguous (or nearly so) and fall within a particular class, e.g., a set of yellow, magenta and cyan (y, m, c) color thermal transfer panels.

Group:

A collection of panels, or sets of panels, that fall within a single technology, e.g., a set of y, m, c panels, a black panel, and one or more panels of precoat or overcoat that all transfer by means of a single type of thermal transfer.

SUMMARY OF THE INVENTION

The invention employs a drum or a belt and clamp with a platen or grit roll to control the movement of a sheet of image-receiving substrate. The drum or platen is operated in cooperation with two or more ribbon/print head systems disposed circumferentially thereabout so as to print successive images on the substrate without removing control thereof. Each of the "print head" systems comprises an energy source and a separately controlled ribbon (or no ribbon, in the case of a direct energy process) for printing in accordance with selected ones of various printing technologies, and over a portion of the printing sequence can operate simultaneously. Positioning of the drum or belt/clamp is monitored by a shaft encoder so as to define the distances between successive lines of image, by which is meant not a line of text but rather a row of dots, wherein the image (text or otherwise) is created from the accumulated effect of many such adjacent and parallel rows of dots (each dot of which is either printed or not, according to the image desired). Determination of the location of the first printable line rests on sensing the leading edge of the clamp that holds the substrate and imposing a predetermined delay therafter so that, e.g., successive yellow, magenta and cyan images can be transferred with food registration between those images using one print head/ribbon system and then, e.g., the substrate can be moved to a second print head/ribbon system for adding black text.

The invention also includes an in-line version. Again, accurate registration between images is accomplished by sensing the edge of a clamp that holds the substrate and thereafter employing a shaft encoder disposed on the apparatus which holds the substrate (either on a drum or a belt/clamp assembly) to define the location of the first printable line and each following line.

In the second aspect of the invention, a transversely movaeably ribbon/print head device is provided as one of said ribbon/print head systems so that an "inserted image" can be transferred to a substrate at one or more arbitrarily and conveniently selected positions, or a larger image can be formed out of a composite of smaller images that have each been so positions.

DETAILED DESCRIPTION

Figure 1A:
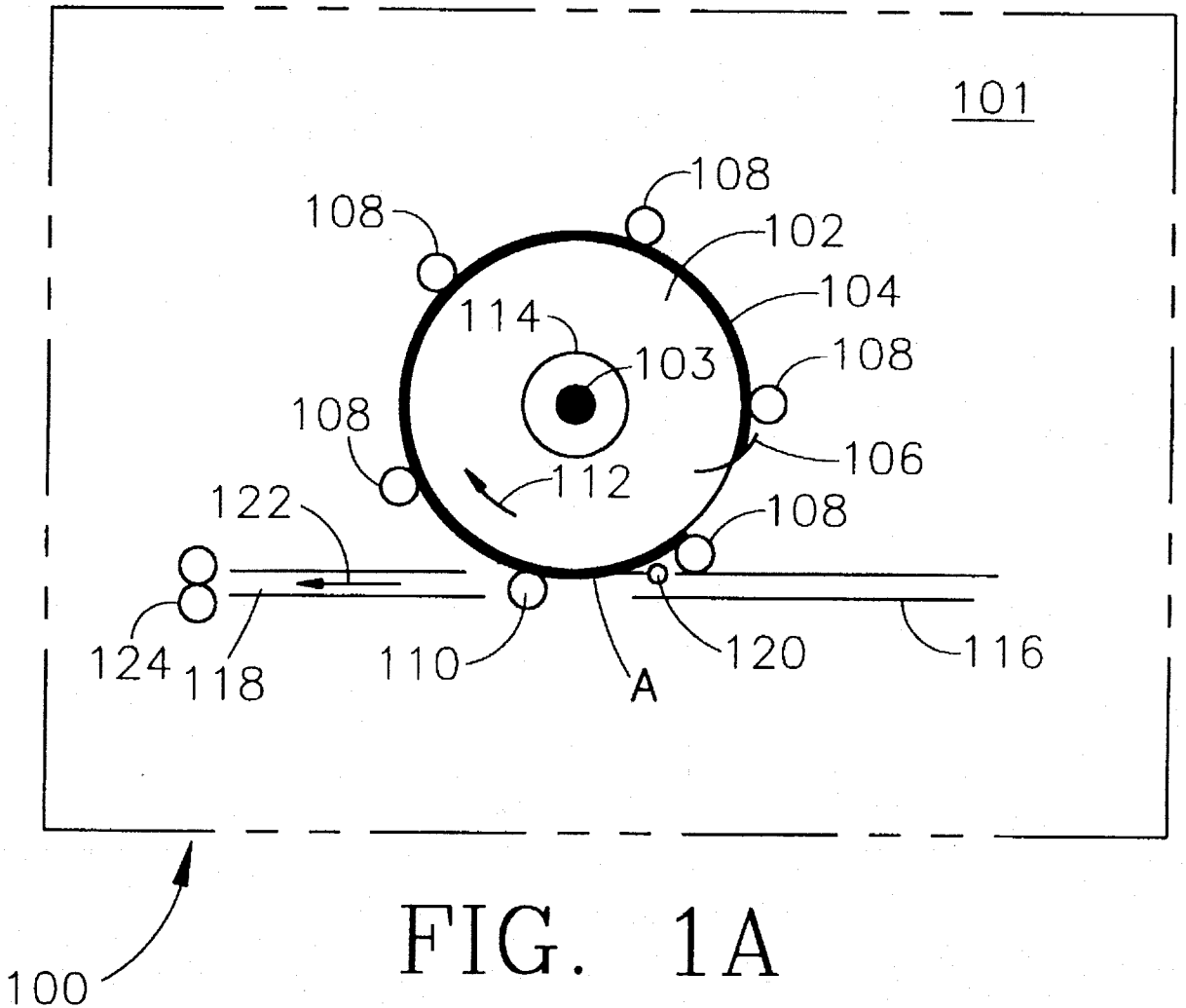
FIG. 1A shows a side elevation view of a mechanism for holding a sheet of substrate to be printed upon onto a drum.

FIG. 1A shows the use of a drum to control the positioning of a sheet of substrate during printing. Drum system 100 is mounted to frame 101 and is structured around drum 102 which is rotatably mounted by shaft 103 to frame 101 through a motor (not shown). (The size of drum 102 is a matter of choice, and depending upon the amount of space available within a particular printer design, may be made sufficiently large to accommodate two sheets of substrate.) At least one sheet of substrate 104 is held onto drum 102 by at least one clamp 106, which is recessed within drum 102 to avoid interference with the printing process but is shown exaggerated in FIG. 1A. Spring-loaded rollers 108, which are rotatably attached to frame 101 and press against drum 102 about the circumference thereof, assist in deeping sheet 104 in place once sheet 104 has been grasped by clamp 106, as also does support roller 110 which is rotatably mounted to frame 101 immediately adjacent drum 102 and just past (to the lower left in FIG. 1A) of printing point A. Upon such grasping by clamp 106, drum 102 rotates in the direction of arrow 112 (clockwise in FIG. 1A) to advance sheet 104 forward so as eventually to reach the position wrapped around drum 102 as shown in FIG. 1A. (A gap of approximately ½ inch of drum area remains between the leading and trailing edges of sheet 104 when so wrapped around drum 102.) A shaft encoder 114 monitors the forward rotation of drum 102 so as to control the printing of successsive lines of image at predetermined distances one from the other. As sheet 104 is being advanced past point A, printing occurs as described with reference to FIG. 1B below.

Drum system 100 further comprises first and second substrate guides 116, 118 which serve to guide sheet 104 up to and away from drum 102, respectively. drum 102 is positioned such that clamp 106 encounters a sheet 104 as the sheet 104 is advanced through first substrate guide 116, and clamp 106 grasps sheet 104. Thereafter, as drum 102 is rotated, a sensor (not shown) detects the presence of the leading edge of clamp 106 that is holding sheet 104 as stated so that printing can commence. The system is instructed to define the first printable line after a predetermined amount of rotation of drum 102 following the sensing of the edge of clamp 106. Thereafter, so as not to waste ribbon, if the first print line actually to be used happens to be the 901st line, then the print head of FIG. 1B noted below is moved forward for printing as perhaps the 875th line is counted.

After printing has been completed, release guide 120, which is rotatably attached to frame 101 near to drum 102 and on the same side thereof as is first substrate guide 116, is rotated under the trailing edge of sheet 104 and drum 102 is then rotated in the direction opposite that of arrow 112 (i.e., counterclockwise in FIG. 1) so as to remove sheet 105 therefrom (i.e., to move sheet 104 in the direction opposite that of arrow 122). As clamp 106 approaches first release guide 120, sheet 104 is released from clamp 106. Sheet 104, which at this time is mainly disposed within first substrate guide 116, is then urged forward through second substrate guide 118 by drum 102 and support roller 110, and is further urged forward by drive rollers 124, which are rotatably mounted to frame 101 and include a drive motor (not shown), for exit from the printer in the direction of arrow 122.

Drum system 100 provides an advantage over the mechanism of Tanaka et al. ('681), in that once printing has begun within drum system 100, the substrate is not removed therefrom. That is, if a sheet 104 is initially printed upon using a yellow panel, drum 102 is further rotated until the edge of clamp 106 is again sensed, and a second printing (e.g., using a magenta panel) is similarly commenced after again defining the first printable line by a predetermined degree of rotation of drum 102. This process can of course be followed by a third or fourth printing, etc., as desired and to the extent to which the ribbon incorporates additional panel types (as in appl. Ser. No. 08/039,871 filed Mar. 30, 1993) for such purposes. In each case, to avoid damage thereto from collision with clamp 106, the print head is moved away from drum 102 during any process that brings clamp 106 near thereto.

Figure 1B:
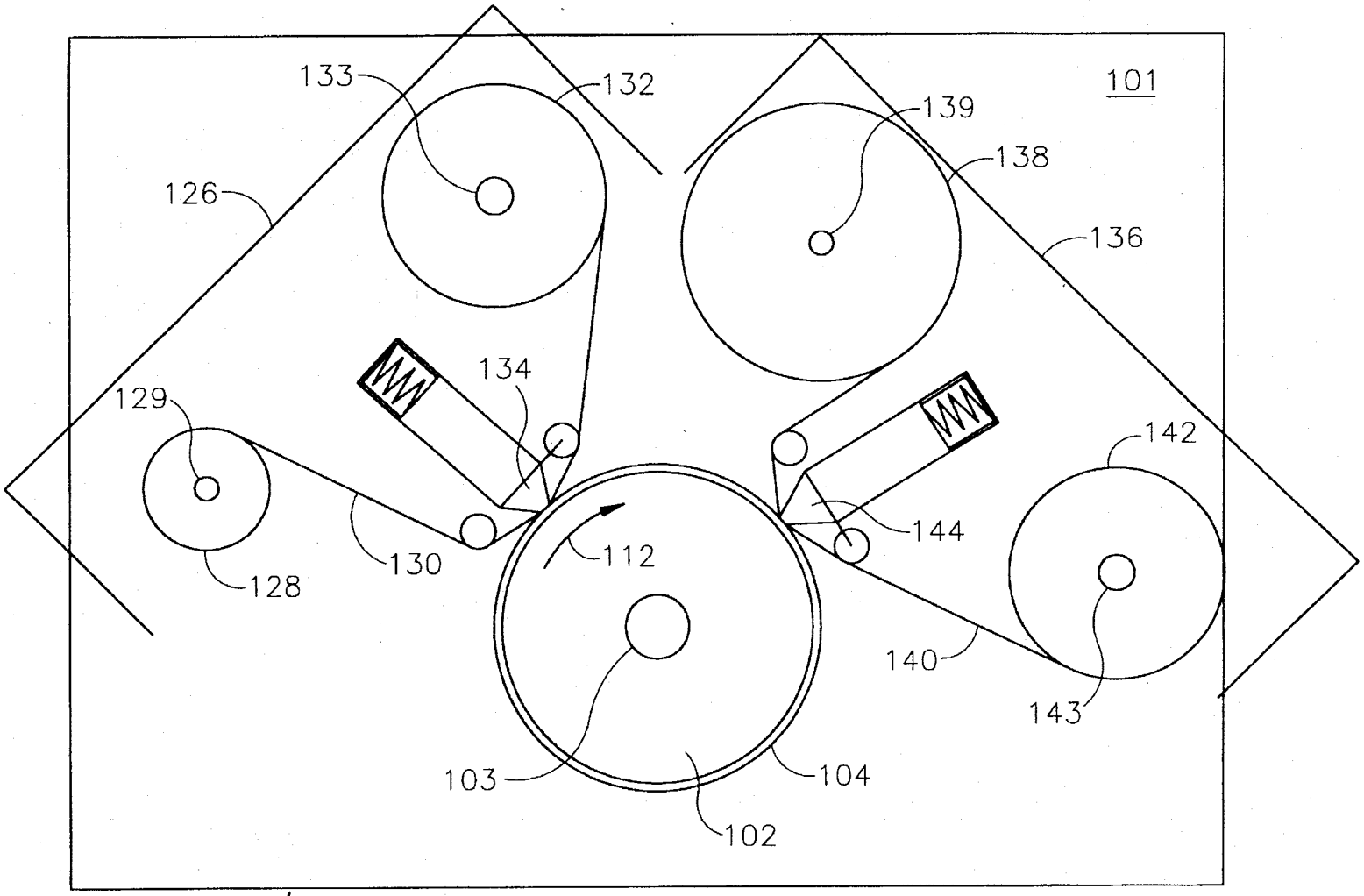
FIG. 1B shows one embodiment of the invention in which two sets of print heads and corresponding ribbons are disposed about the drum of FIG. 1A.

Upon completion of printing using s single ribbon/print head system, sheet 104 need not be removed from drum 102 for subsequent printing by another ribbon/print head system. As shown in FIG. 1B, more than one ribbon/print head system can be given access to a sheet 104 as the same was initially disposed on drum 102, so that no registration errors will be introduced in moving from one ribbon/print head system to the other. The second printing (or third, etc., in the event that the printer has more than two ribbon/print head systems) likewise commences by sensing the leading edge of claim 106, in this case (as noted below) by a sensor that is disposed near to the second (or third, etc.) ribbon/print head system. Counting by means of the shaft encoder is thereupon commenced to define the first and subsequent printable lines for the particular printing. (Since the displacement of each particular sensor from each respective ribbon/print head system may vary, the actual encoder count that defines the first printable line may not be the same in each of the two or more ribbon/print head systems, but that count is nevertheless fixed and determinable as to each one.)

The apparatus of FIG. 1B is thus distinguishable, e.g., from that of appl. Ser. No. 08/047,144 filed Apr. 12, 1993, in that the ribbon/print head systems of FIG. 1B are disposed on the outer periphery of the printer and advance "inwardly," i.e., the print head is moved towards the center of the printer to contact the ribbon and carry out the printing process. It is that conceptual change in structure that permits a sheet of substrate to be grasped and held but once, either by a drum or a belt/clamp, but then to be accessed by different print heads.

More specifically, FIG. 1B shows two ribbon/print head systems disposed about drum 102. A first ribbon/print head system 126 includes first supply roll 128, which is ratably mounted to frame 101 by shaft 129 and which dispenses first ribbon 130 onto first takeup roll 132, which is also rotatably mounted to frame 101 by shaft 133. Disposed between first supply roll 128 and first takeup roll 132 is first print head 134, which is electronically operated and driven forward for printing purposes by a motor (not shown) in the usual fashion. In the structure of drum system 100, first print head 134 is driven "inwardly" towards drum 102 for printing as previously stated. It may be noted that while ribbon 130 is disposed on first supply roll 128 with the "printing side"

thereof facing inwardly, ribbon 130 is taken up by first takeup roll 132 so that the printing side faces outwardly. Such an arrangement is a matter of choice, except that by such a disposition it may become easier, when installing a new ribbon, to note which of the two rolls (128, 132) is to be placed on which shaft (129, 133).

Drum system 100 further comprises second print head system 136, which is disposed at a different location about drum 102 than is first print head system 126, and includes second supply roll 138 which is rotatably mounted to frame 101 by shaft 139, which dispenses second ribbon 140 onto second takeup roll 142, and which is also rotatably mounted to frame 101 by shaft 143. As in first print head system 126, second ribbon 140 is disposed on its second supply roll 138 with the print side down, but is taken up by second takeup roll 142 with the print side facing outwardly. Disposed between second supply roll 138 and second takeup roll 142 is second print head 144, which may be of the same or of a different type than is first print head 134.

From the structure shown in FIG. 1B, it is clear that by repeated rotation of drum 102, successive printings on substrate 104 can be carried out by either or both of first and second print heads 134, 144. Of course, in this and the following embodiments, which print head is "first" and which is "second" is arbitrary: the user has the choice of which printing task is to be carried out by which print head, as determined by the nature of the ribbons and print heads installed. Indeed, such ribbon and print head selection and subsequent control can be carried out automatically by use of a programmed printer controller which senses the ribbon type, the disposition of precoat, color or black panels, etc., on such ribbons, and indeed identifies unused ribbon portions as described in appl. Ser. No. 08/039,871 filed Mar. 30, 1993.

In rotating in the direction of arrow 112, drum 102 will transport clamp 106 (shown in FIG. 1A) and hence substrate 104 entirely past both first print head 134 and second print head 144, and also past first and second ribbons 130, 140 associated therewith. For example, first ribbon 130 may include a repeating series of yellow, magenta and black panels of the thermal transfer type, so that to carry out the first image transfer (e.g., from the yellow panel), both first ribbon 130 and substrate 104 are advanced past first print head 134, preferably at the same speed during printing. Upon completion of that image transfer, drum 102 is further rotated until clamp 106 again approaches first print head 134, while at the same time first ribbon 130 is advanced to the next desired (e.g., magenta) color panel and the process is repeated as desired.

Upon completion of the desired printing using first ribbon 134, drum 102 rotates further to the position at which clamp 106 is coming near to second print head 144. Second ribbon 140 may comprise, e.g., a continuous black panel for printing text over a full color image, in which case such printing may be accomplished during a single pass of substrate 104 past second print head 144. It may be noted that in FIG. 1B, first supply roll 128 is depicted as being "smaller" than first takeup roll 132, i.e., first takeup roll 132 has in fact taken up more than one half of first ribbon 130, while on the other hand second supply roll 138 is shown as being "larger" than second takeup roll 142, meaning that the latter has taken up less than one half of second ribbon 140. It is intended to emphasize by that depiction that first and second print head systems 126, 136 do indeed function independently, except insofar as substrate 104 must be in the required positions for printing from both of first and second print head systems 126, 136, as controlled respectively by a count derived from shaft encoder 114 of FIG. 1A. Thus, print data might for example be transmitted to second print head 144 after some fixed rotation of drum 102 as indicated by shaft encoder 114 following detection of clamp 106, such as that corresponding to a predetermined number of inches of circumference on the substrate surface. Any well known means for separating composite electronic print data into at least two subsets for separate direction to the two or more energy sources may be employed to accomplish the desired printing at each of said two or more print stations. (For particular tasks, and except insofar as some inks or dyes may require some time for drying or otherwise equilibrating before being disturbed, nothing prevents printing form first and second print head systems 126, 136 at the same time, by proper correlation of instructions to transmit print data thereto as determined by particular readings of shaft encoder 114.) Upon completion of the desired printing at both such locations—or at three or more location or a single location, depending on the number of print head/ribbon systems in a particular embodiment of the invention and on the nature of the printing task at hand—substrate 104 can be removed from drum 102 as previously described.

The use of a drum (and associated slamp to hold the substrate) with multiple print head/ribbon systems, which allows accurate registration between images, as for example between successive yellow, magenta and cyan images that are transferred by separate print heads, has not previously been shown in the art and is thus novel to the present invention.

The term "preint head" is of course used in a generic sense: what is specifically required here is merely an energy source (and associated application means) fo one of the types previously defined for conducting printing of a type appropriate to the nature of the ribbon being used. (Indeed, if any portion of substrate 104 is adapted to receive an image by a direct energy process, one or the other of first and second print heads 134, 144 may be a direct energy source, in which case the ribbon associated with such a one of first and second print heads 134, 144 would be detected. When a light source such as a laser is used, the application means may comprise mirrors and prisms to access each of the two or more printing stations using a single laser.)

Also, the importance of being able to print yellow, magenta and cyan using just one print head (and black using another) cannot be overstressed. For very precise registration, it must be recognized that two print heads that are ostensibly identical may differ slightly in sensitivity or response time when detecting the appearance of the clamp, so that error may result in defining the position of the first printable line, etc. Such sources of error have no effect, however, with regard to printing within a single ribbon/print head system, while on the other hand the availability of the second ribbon/print head system for printing black text avoids need to use the more expensive y, m, c, b ribbon and permits faster printing of text.

Figure 2:
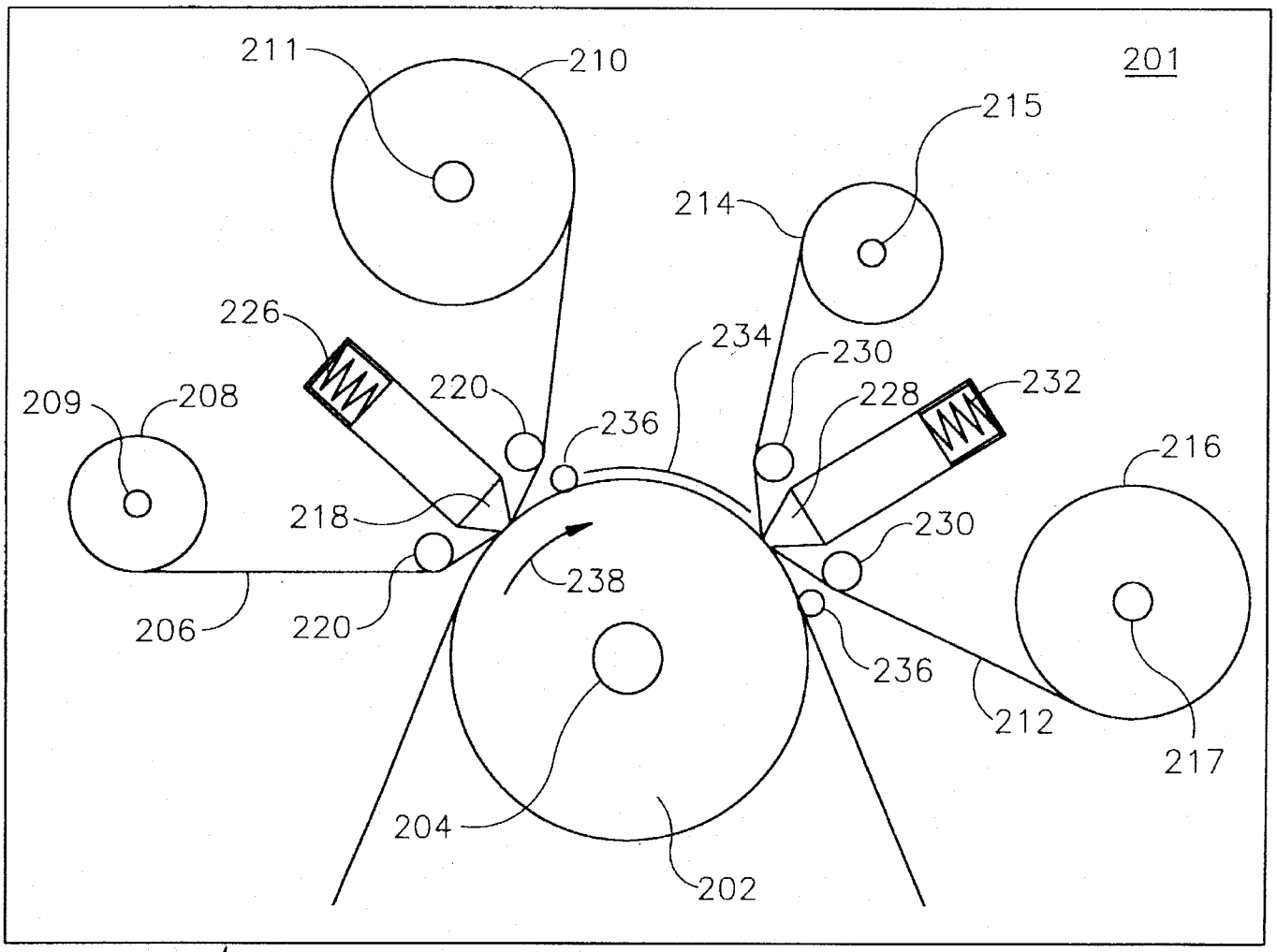
FIG. 2 shows another embodiment of the invention having circumferentially disposed print heads, a centrally located platen, and a belt and clamp for moving the substrate.

FIG. 2 shows a structure similar to that of FIG. 1B except employing a platen in lieu of a drum. The distinction between a platen and drum essentially lies in the fact that the drum grasps and holds the substrate but the platen does not. Both the drum and platen work by frictional pressure to advance the ribbon while printing, but the platen lacks positive control of the substrate, e.g., during successive transfers of yellow, magenta and cyan images. Consequently, control of substrate movement many not be as precise with the platen as with the drum, but is adequate nevertheless for many printing purposes. Indeed, such a procedure is quite adequate in the context of FIG. 2 in the case that the second ribbon/print head system is intended to provide an "inserted" image for which precise registration relative to that of the first ribbon/print head system is not required.

Specifically, FIG. 2 shows a platen system 200 having a frame 201 to which is rotatably mounted a platen 202 by shaft 204. Platen system 200 includes a first ribbon 206 that may include on one side thereof, e.g., a repeating series of yellow, magenta and cyan color panels of heat sensitive ink or dye, each of such panels having a length nearly equal to that of the substrate to which an image is to be transferred. First ribbon 206 is unwound from a first supply roll 208 rotatably mounted on frame 201 by shaft 209, and after use as will be discussed below, first ribbon 206 is wound onto first takeup roll 210, also rotatably mounted on frame 201 by shaft 211. Both of first supply roll 208 and first takeup roll 210 ar provided with reversible stepping motors (not shown) whereby either of rolls 208, 210 can be energized to rotate and draw first ribbon 206 from the other, and both of rolls 208, 210 are provided with slip clutches (also not shown) in the usual manner so that first ribbon 206 can be drawn from one to the other under tension. The side of first ribbon 206 that bears the aforsaid panels in this case faces outwardly from first supply roll 208 and first takeup roll 210.

Platen system 200 further comprises a second ribbon 212, which may, e.g., be a multiprint black ink ribbon for printing on plain paper. Second ribbon 212 is unwound from a second supply roll 214 which is rotatably mounted on frame 201 by shaft 215, and after use second ribbon 212 is wound onto second takeup roll 216, also rotatably mounted on frame 201 by shaft 217. Second supply roll 210 and second takeup roll 212 are likewise provided with stepping motors and slip clutches (not shown), and similarly the side of second ribbon 208 that bears the panels faces outwardly from second supply roll 214 and second takeup roll 216.

For illustration, platen system 200 will now be further described in terms of a thermal printing process, although the specific method to be employed is not so limited and may include any of the options defined previously under the "Terminology" section above (i.e., using different technologies, different classes, groups or sets of panels, etc.). As also shown in FIG. 2, platen system 200 further comprises a first print head 218 and first ribbon guides 220 which serve to define the angle of contact between first ribbon 206 and platen 202. A sheet of substrate 224 is "sandwiched" between first ribbon 206 and platen 202 to be printed upon in the usual method of thermal transfer. (Mechanisms for bringing a sheet of substrate up to the structure of FIG. 2, and for removing such a sheet once it has been printed upon, have been described in appl. Ser. No. 08/039,871 filed Mar. 30, 1993 and in appl. Ser. No. 08/047,144 filed Apr. 12, 1993.) On the outward side of first print head 218 there is mounted to frame 201 a spring-loaded first driver motor 226 in the usual fashion so as to cause forward or backward motion of first print head 218 as desired. Platen system 200 further comprises a second print head 228 and second ribbon guides 230 which serve to define the angle of contact between second ribbon 212 and platen 202. Likewise, a spring-loaded second driver motor 232 is mounted to frame 201 outwardly from second print head 228 in the usual fashion so as to cause forward or backward motion of second print head 228 as desired for printing.

In light of the variety of panels available on both first and second ribbons 206, 212, and the need on occasion to traverse through one or the other of those ribbons in order to come to a desired type of panel, it must be possible when so doing (i.e., when not printing) to draw both of first and second print heads 218, 228 back from the corresponding first and second ribbons 206, 212 so as (1) to avoid unnecessary wear on the respective print head; (2) to avoid advancing (or wearing upon) a sheet of substrate 224 disposed between one or the other ribbon and platen 202; and (3) to avoid wastage of ribbon, especially in a printer that is not equipped (as described in appl. Ser. No. 08/039,871) to identify unused ribbon portions. To assist in controlling a sheet of substrate 224 during such process, platen system further comprises substrate guide 234 fixedly attached to frame 201 to help guide the leading edge of substrate 224 from the region of first print head 218 to that of second print head 228, as well as pinch rollers 236 that are rotatably attached to frame 201 and aid in holding a sheet of substrate 224 against platen 202.

It should be noted that in FIG. 2, both of first and second print heads 218, 228 are disposed to conduct printing on substrate 224 simultaneously. That is, shortly after the encounter of substrate 224 with platen 202 by rotation of the latter in the direction of arrow 238, printing by first print head 218 and first ribbon 206 can commence. The timing by which such printing is initiated at the first printable line and subsequently continued as to each line thereafter can be controlled as previously described, and as also described in appl. Ser. No. 08/029,871 filed Mar. 30, 1993 and appl. Ser. No. 08/047,144 filed Apr. 12, 1993, e.g., by a sensor (not shown) that has detected the leading edge of substrate 224 and by a pulse count generated by a shaft encoder (not shown) on the platen shaft in the manner of the previous embodiment of the invention (FIG. 1A). The circumferential distance R along the print surface of the substrate between first print head 218 and second print head 228, and the nature of the desired second image, defines the number of encoder pulses at which printing should commence using second ribbon 212 and second print head 228. For accurate registration of successive images, it is also required, of course, that first and second print heads 218, 228 be aligned precisely parallel. During all of such printing, it may be noted that (1) substrate 224 will be held against platen 202 by at least one of pinch rollers 236.

Although the structure of FIG. 2 appears similar to that of FIG. 2 of the Moriguchi et al. '302 patent, that patent merely describes the use of two or more print heads ribbons in a conventional thermal transfer process to transfer successive colors onto a substrate in forming a full color image. The present invention is thus distinguished in part by the fact that either or both of first and second ribbons 206, 212, and similarly first and second "print heads" 218, 228, include any desired combinations of printing technologies, or of panel sets, groups, etc., including the use of precoat or overcoat, that are adapted therefor as previously noted. In particular, deposition of, e.g., precoat onto a substrate, can be carried out using a print head of lower (e.g., 150 DPI) resolution than is used in full color image transfer, thereby saving expense both in the cost of the print head and in the amount of memory required to transmit print data for those fewer but larger dots. Moreover, the successive transfer of color images (e.g., yellow, magenta and cyan) that is carried out by successive print heads in the indicated patent can instead be carried out by a single print head in the present invention, by reciprocating movement of platen 202 and an appropriate ribbon, hence the one or more additional print heads of the invention can be used for additional purposes as previously noted. During such reciprocal movement of platen 202, substrate 224 continues to be held by the particular pinch roller 236 that is located just in front of the ribbon 206 or 212 being used, so printing can take place very near to the leading edge of substrate 224, and secondly that holding action of pinch roller 236 allows such back and forth movement without introduction of unacceptable registration errors.

Similarly, to obtain accuracy of registration between successive images, the Moriguchi et al. '212 patent relies on a constant speed of movement of the belt which transports the substrate, whereas in the present invention the use of a shaft encoder defines such registration accuracy in terms of specific accurately measurable displacements of the substrate instead. Dependence upon a constant rate of substrate movement, in light of feedback errors known to occur with constant speed motors, may be acceptable in the case of printing with just one color, but becomes unacceptable when different colors are to be printed successively onto the same substrate, hence the method of positive substrate control using a rotary encoder as in the present invention becomes essential.

In addition, it is known to achieve a resolution that is effectively twice that of the resolution of the print head itself by moving the substrate by one-half lines between successive printing of a dot rather than by the full lines that would be defined, e.g., by a 300 DPI print head—that is, by 1.67 mil rather than 3.33 mil. That process can also be carried out using the present invention since, in the embodiments of the invention that employ such an encoder, (1) the substrate is initially grasped by a clamp and remains so held during the multi-image printing process; and (2) there is defined a fixed displacement of each respective sensor from the corresponding print head so that the precise location on the substrate of the fist printable line and each subsequent line or half-line is thus determinable. It will be noted below, however, that the present invention also, and uniquely, provides means for achieving such "double resolution" printing in the transverse as well as the longitudinal direction.

Figure 3:
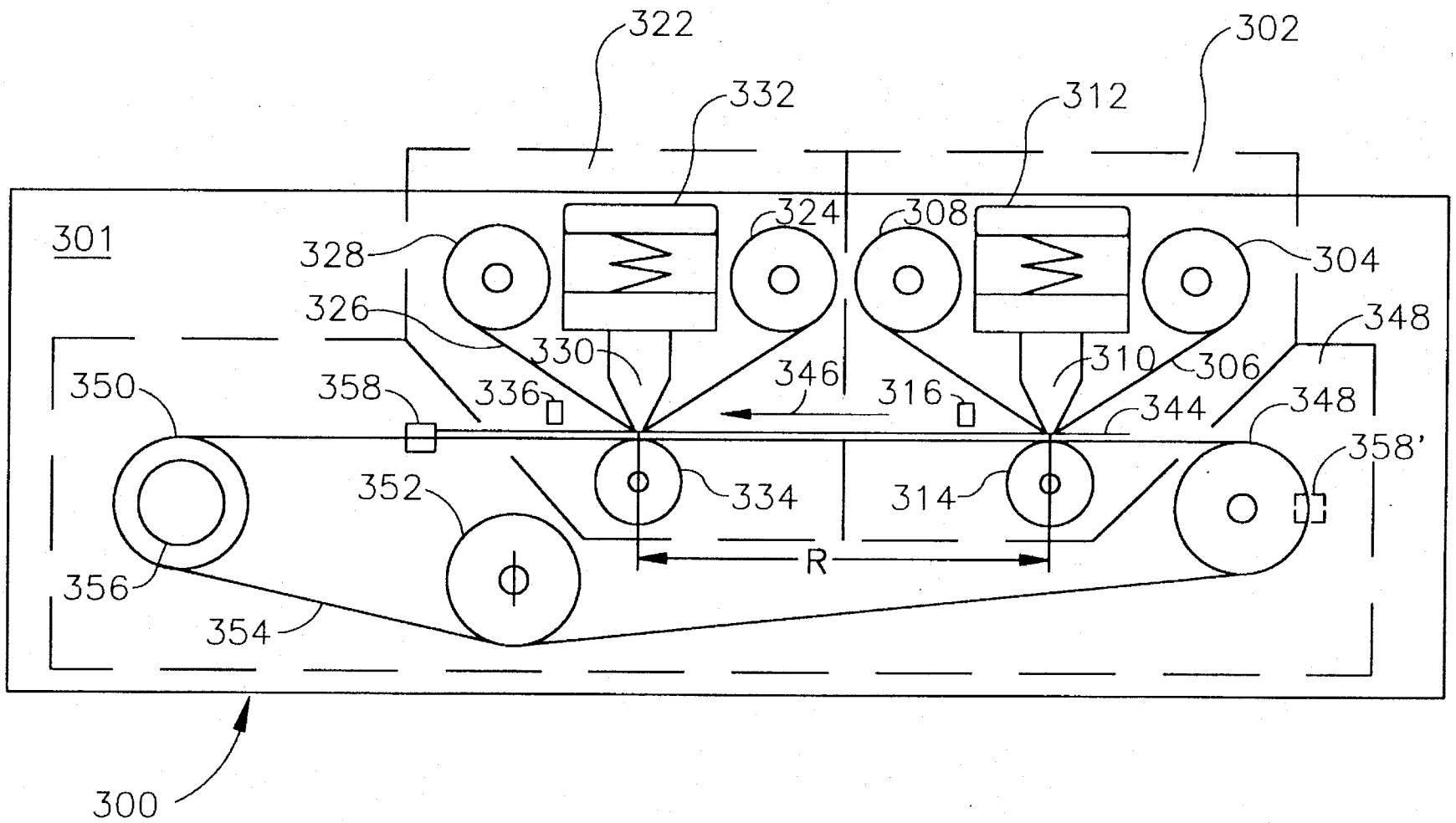
FIG. 3 shows a version of the embodiment of FIG. 2 in which the print heads are disposed along a line.

FIG. 3 shows a variation of the invention in which successive print heads are arranged in line. Specifically, print assembly 300 is mounted on frame 301 and includes as major components first print station 302, second print station 322 and substrate assembly 342. First print station 302 further comprises first supply roll 304, first ribbon 306, and first takeup roll 308, which are respectively disposed as, and operate in the manner of, the ribbon assemblies previously described and shown in FIG. 2. First print station 302 also includes first print head 310, first print head motor 312 (for moving first print head 310), first platen 314 and first sensor 316. Second print station 322 further comprises second supply roll 324, second ribbon 326, and second takeup roll 328, which are likewise disposed as, and operate in the manner of, the ribbon assemblies of FIG. 2, except in that second print station 322 is displaced from first print station 302 a distance R along a straight line (rather than about the circumference of the circle defined by the substrate surface as in FIG. 2). Second print station 322 also includes second print head 330, second print head motor 332 (for moving second print head 330 forward and backward), second platen 334 and second sensor 336.

Substrate assembly 342 serves to conduct a sheet of substrate 344 in the direction of arrow 346 so as to accept the transfer of successive images from first and second print stations 302, 322, in the general manner as shown and described with reference to FIGS. 7A, 7B of appl. Ser. No. 08/047,144 filed Apr. 12, 1993. That is substrate assembly 342 further comprises first and second belt wheels 348, 350 and spacer wheel 352, each of which are rotatably connected to frame 301 and around which is wrapped belt pair 354. Preferably, spacer wheel 352 is also slidably mounted to frame 301 (as within a slot and lock) so as to permit some movement thereof outwardly (downwardly in FIG. 3) from first and second belt wheels 348, 350, and thus to establish a desired degree of tension in belt pair 354. Motor/encoder 356 is also attached tot he shaft of second belt wheel 350 and serves (1) to drive second belt wheel 350 and hence belt pair 354 in the direction of arrow 346 and (2) to provide a record of the position of clamp 358 that connects across belt pair 354 (as shown in the plane view of FIG. 7A of appl. Ser. No. 08/047,144 filed Apr. 12, 1993). Clamp 358 serves to grasp the leading edge of a sheet of substrate 344 and convey the same through first and second print stations 302, 322 for printing thereupon.

Sheets of substrate 344 are supplied to print assembly 300, e.g., from alternative substrate trays as shown in FIG. 1 of appl. Ser. No. 08/047,144 filed Apr. 12, 1993. In FIG. 3 herein, clamp 358 is shown in outline as clamp 358' in the lower right hand corner thereof in a position passing around first belt wheel 348, i.e., in a position so as to initially grasp a sheet of substrate 344. Upon further activation of motor/encoder 356, substrate 344 will be transported in the generally counterclockwise direction indicated by arrow 346, so that clamp 358 comes into position to be detected by first sensor 316. Following that first detection of substrate 344, the first printable line thereof is defined as previously described, and first print station 302 can commence a first printing operation which,, if it is taken that first ribbon 306 has already been placed in a position such that a desired panel thereof is appropriately lined up therefor, consists of (1) energizing first print head motor 312 so as to move first print head 310 forward (downward in FIG. 3) into contact with first ribbon 306, and the (2) transmitting print data to first print head 310 in the desired image pattern. First takeup roll 308 is energized by a motor (not shown) so as to advance first ribbon 306 at the same rate at which belt pair 354 (as driven by motor/encoder 356) advances substrate 344, and first platen 314 can be allowed to rotate under some frictional resistance thereto in response to the movement of clamp 358 and substrate 344 so as to maintain a degree of tension within substrate 344. After some movement (i.e., approximately the distance R) of substrate 344 as just described, clamp 358 will come into a position to be detected by second sensor 336, and printing at second print station 322 can commence in the same manner as was just described with reference to first print station 302. As in the previously embodiment of FIG. 2, printing can occur simultaneously in first and second print stations 302, 322 (or, e.g., in a third print station as well for separate printing of yellow, magenta and cyan), and for additional printing, substrate 344 can be transported entirely around the path of belt pair 354 so as to be sensed again by first sensor 316, and further printing can then be carried out as previously described. (Continued counterclockwise movement of substrate 344 is preferred to reverse movement thereof in order to maintain the pre-established degree of tension in substrate 344. Also, although printing by two or more print heads at once is possible, for the highest registration accuracy, and to avoid inordinate stretching or substrate 344 when the print head pressure over platens 314, 334, etc. is high, it is preferable to print with just one print head at a time.)

Figure 4:
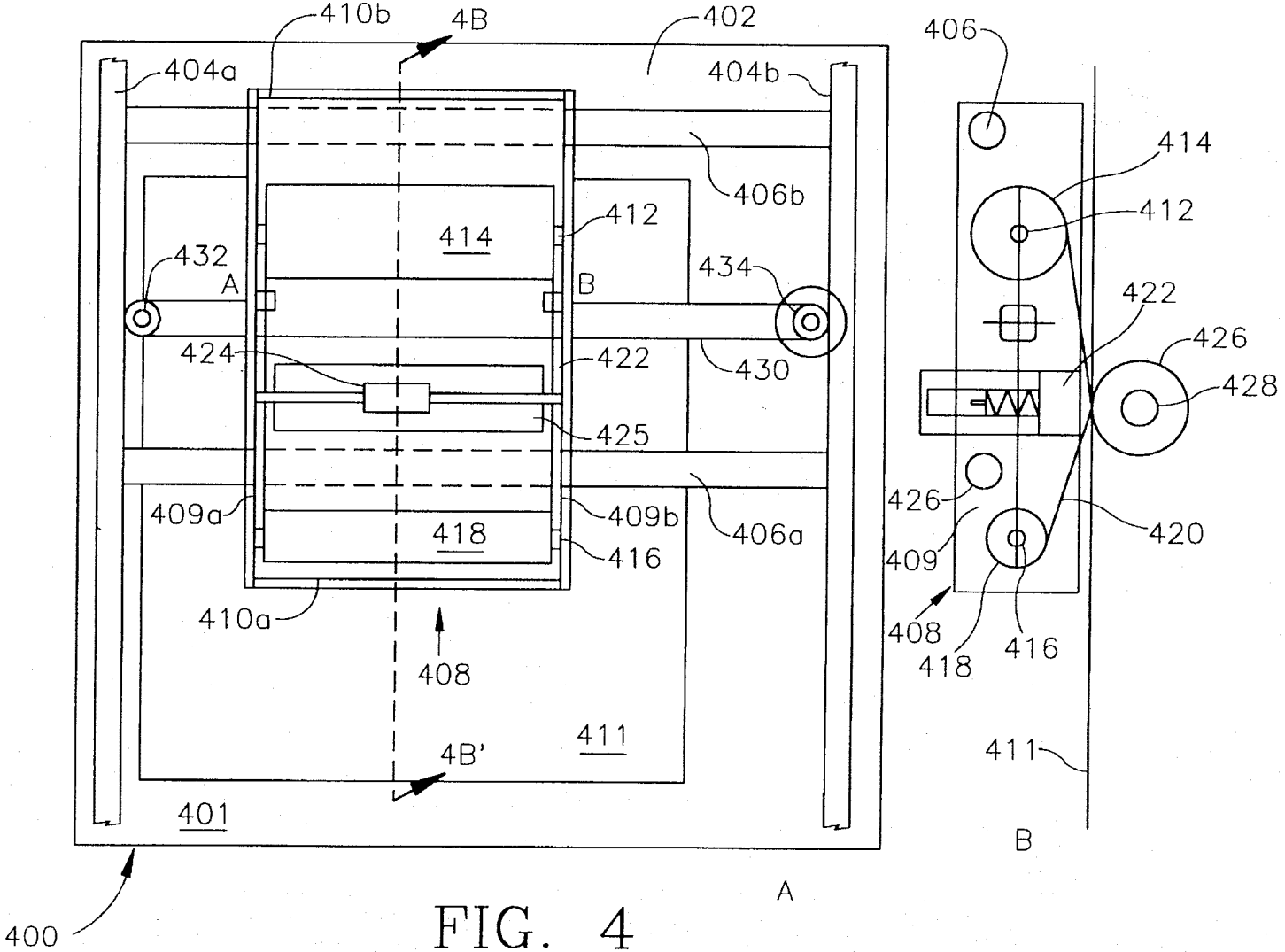
FIG. 4 shows a belt mechanism for providing control of the transverse placement of a ribbon/print head combination relative to a substrate.

The following description outlines an additional capability of the invention wherein advantage is taken of the indicated control of the substrate. Specifically, FIG. 4 shows a device that permits placement of an image from a print head that is of a shorter length than the width of the image-receiving substrate at a desired transverse position on that substrate. Image positioner 400 as mounted on printer frame 401 is shown in both a top plan (4A) and a cross-sectional (4B) view taken through the line 4B–4B' of FIG. 4A. Image positioner 400 includes a carriage frame 401 by means of first and second frame members 404*a*, 404*b*, which are in turn interconnected by cross members 406*a*, 406*b*. Carriage 408, which principally comprises two parallel plane members 409*a*, 409*b* and firs and second struts 410*a*, 410*b* is slidably mounted to cross members 406*a*, 406*b* and provides the desired positioning action. As can be seen in FIG. 4A, carriage 408 is positioned to lie "above" a sheet of substrate 408 substrate 411.

Carriage 408 further comprises supply shaft 412 disposed transversely between members 409*a*, 409*b* and onto which supply roll 414 is rotatably mounted, takeup shaft 416 which is likewise disposed transversely between members 409*a*, 409*b* and onto which takeup roll 418 is rotatably mounted, and ribbon 420 which is disposed between supply roll 414 and takeup roll 418 in the usual fashion. Also mounted on carriage 408 is a print head 422 which faces ribbon 420 in the usual manner and is controlled in terms of motion towards and away from ribbon 420 by spring-loaded motor 424 that is mounted to third strut 425 that extends between members 409*a*, 409*b*. A platen 426 or the like (which is "behind" substrate 411 and thus not seen in FIG. 4A) is rotatably mounted to frame 401 by shaft 428 and faces towards substrate 411 so that ribbon 420 can be pressed against substrate 411 by print head 422 in the usual manner.

Positioning of th assembly that includes supply roll 414, takeup roll 418, ribbon 420 and print head 422, and which thus defines the transverse location on substrate 411 at which print head 422 will act to transfer an image, is controlled by a belt 430 that extends from first side of carriage 408 at connection point A on member 409*a*; thence to first pulley 432 which is attached to first frame member 404*a*; thence across carriage 408 to reversible pulley/motor 434 which is attached to second frame member 404*b*; and thence to a second side of carriage 408 at connection point B on member 409*b*. By activation of reversible pulley/motor 434, it is clear that the transverse (horizontal in FIG. 4A) position of carriage 408 can be adjusted relative to the underlying position of substrate 411, and hence that the position on substrate 411 at which an image will be transferred by print head 422 can be adjusted as desired. This mechanism thus has an advantage over that which employed spacers for such transverse adjustment purposes as described in appl. Ser. No. 08/047,144 filed Apr. 12, 1993, in that the positioning of carriage 408 is incrementally adjustable, and further that such positioning can be carried out by electronic control (e.g., as by a rheostat) without requiring manual entry into the printer.

Figure 5:
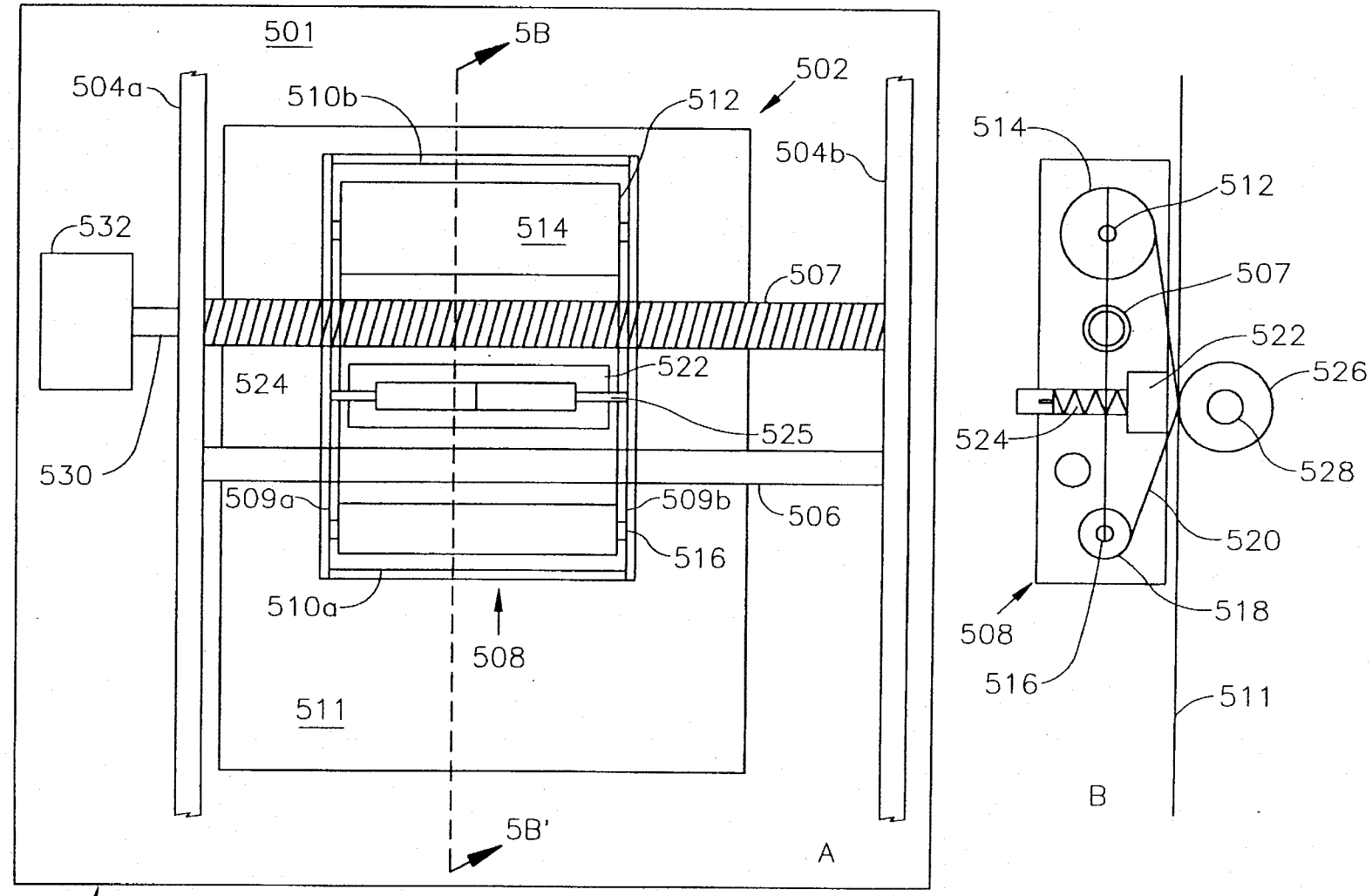
FIG. 5 shows an alternative gear mechanism for controlling the transverse placement of a ribbon/print head combination relative to a substrate.

A similar mechanism for such transverse positioning of a carriage which bears the printing system is shown in FIG. 5. Specifically, image positioner 500 as mounted on printer frame 501 is shown in both a top plan (5A) and a cross-sectional (5B) view taken through the line 5B–5B' of FIG. 5A. Image positioner 500 includes a carriage frame 502 that is fixedly mounted to printer frame 501 by means of first and second frame members 504*a*, 504*b*, which are in turn interconnected by cross member 506 which is fixedly mounted therebetween, and by threaded bolt 507 which is rotatably mounted therebetween. Carriage 508, which principally comprises two parallel plane members 509*a*, 50(*b* and first and second struts 510*a*, 510*b* is slidably mounted to cross member 506 and screwably mounted to threaded bolt 507 and provides the desired positioning action. As can be seen in FIG. 5A, carriage 508 is positioned to lie "above" a sheet of substrate 511.

Carriage 508 further comprises supply shaft 512 disposed transversely between members 509*a*, 509*b* and onto which supply roll 514 is rotatably mounted, takeup shaft 516 which is likewise disposed transversely between members 509*a*, 509*b* and onto which takeup roll 518 is rotatably mounted, and ribbon 520 which is disposed between supply roll 514 and takeup roll 518 in the usual fashion. Also mounted on carriage 508 is a print head 522 which faces ribbon 520 in the usual manner and is controlled in terms of motion towards and away from ribbon 520 by a spring-loaded motor 524 that is mounted to third strut 525 that extends between members 509*a*, 509*b*. A platen 526 or the like (which is "behind" substrate 511 and thus not seen in FIG. 5A) is rotatably mounted to frame 501 by shaft 528 and faces toward substrate 511 so that ribbon 520 is pressed against substrate 511 by print head 522 as usual.

Positioning of the assembly that includes supply roll 514, takeup roll 518, ribbon 520 and print head 522, and which thus defines the transverse location on substrate 511, at which print head 522 will act to transfer an image, is controlled by rotation of threaded bolt 507, which as indicated passes through a like set of threads within carriage 508 and is rotatably connected at respective ends thereof to first and second frame members 504*a*, 504*b*. As one means of rotating threaded bolt 507, FIG. 5A shows an extension shaft 530 which extends outwardly from first frame member 504*a* and onto the end of which is located knob 532 which can be manually turned so as to turn threaded bolt 507. Of course, rotation or turning of threaded bolt 507 can optionally be controlled by a motor (not shown) as in the embodiment of FIG. 4.

In either of the embodiments of FIGS. 4, 5 it becomes possible in this aspect of the invention not only to print different images using different print heads on a single sheet of substrate, but if either of the structures of FIGS. 4, 5 is taken to replace one or more of the print heads of, e.g., FIG. 3, any of such images can be placed at any desired transverse location across the width of the substrate. By controlling the timing by which print data are sent to the print head, a desired placement along the length of the substrate is also achieved in the usual manner. Indeed, by repeated use of one or the other of the structures of FIGS. 4, 5 in conjunction with reciprocating movement of the substrate beneath either of those structures in the usual fashion, an image can be created that encompasses the full size of that substrate even though the print head extends only part of the way thereacross. Thus, for economic reasons, a print head that is of a smaller length (e.g., 4 inches) can be employed to produce a full 8-inch image, or for greater printing capability a larger substrate (e.g., 18 inches in width) and similarly larger substrate-handling capabilities (i.e., substrate trays, guides and the like) can be used with an 8-inch print head to print a 16-inch or even larger image.

Figure 6:
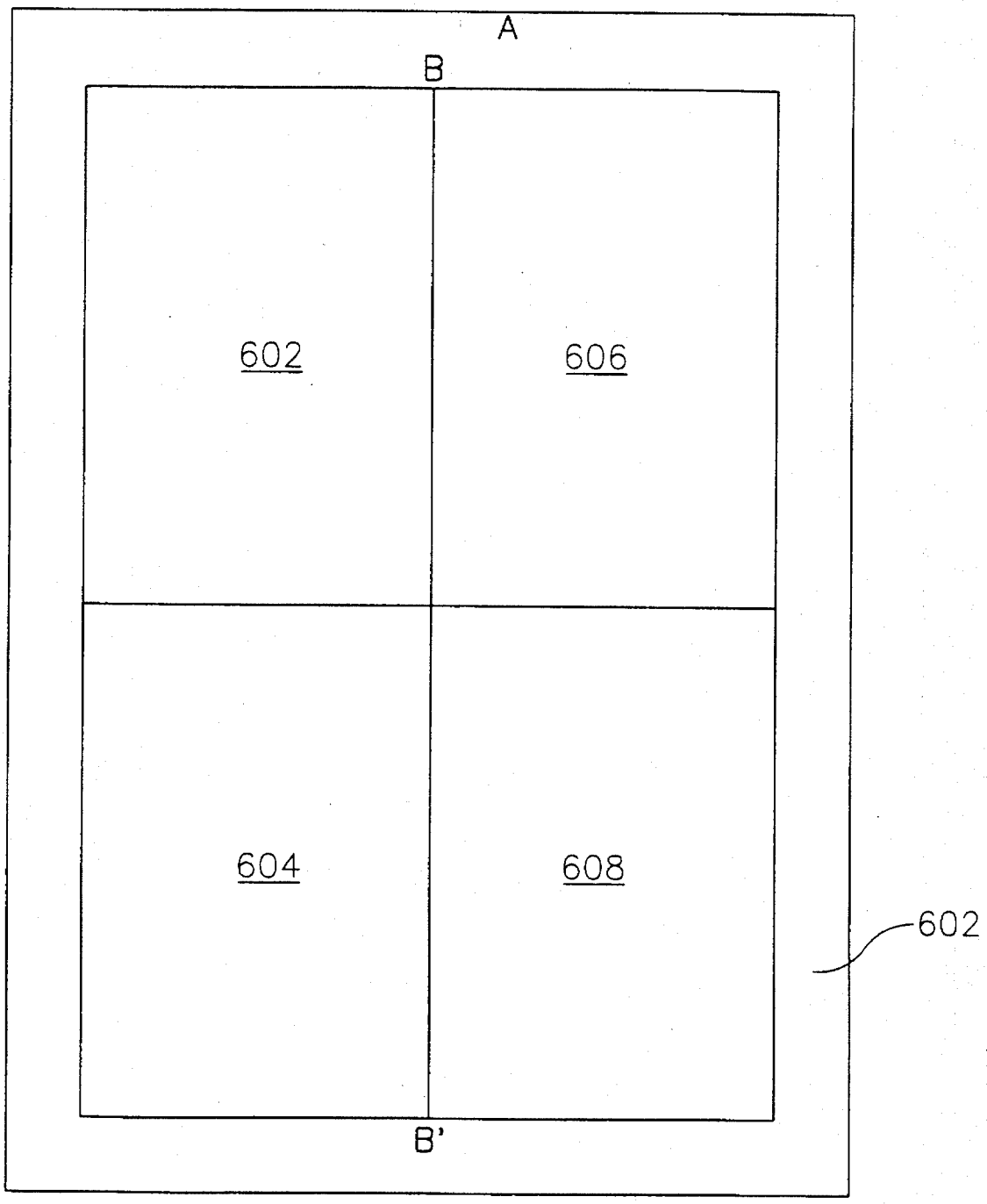
FIG. 6 shows an example of placing multiple images at separate location on a single substrate using the mechanisms of FIGS. 4 or 5.

An example of such a process is shown in FIG. 6, which includes a sheet of substrate 600 and successive first, second, third and fourth print regions, 602, 604, 606 and 608. In an initial printing, substrate 600 is grasped at the leading edge A thereof at a time that, for example, carriage 408 of FIG. 4 is disposed at the far right side of carriage frame 402. Transport of substrate 600 upwardly in FIG. 6, or of substrate 411 downwardly in FIG. 4, will then, along with an appropriate transmission of print data, result in an image transfer in first print region 602. First and second print regions 602, 604 may be distinguished as indicated for the reason, e.g., that each of them correspond approximately to the size of a single panel on a ribbon. In any case, continued transport of substrate 600 (or 411) as indicated and corresponding transmission of additional print data will then cause the transfer of an image into second print region 604. Carriage 408 (or carriage 508 in FIG. 5) is then moved to the far left side by pulley/motor 434 in FIG. 4 ( or by turning threaded bolt 507 in FIG. 5), and print data for the transfer of an image in third print region 606 is transmitted, and similarly as to additional data in fourth print region 608. Accurate longitudinal placement of the substrate (e.g., by detection of clamp 358 as previously described) is of course required.

It should be noted that just as previous embodiments of the invention have employed a shaft encoder to record and control the longitudinal movement of a sheet of substrate, so can either of the apparatus of FIGS. 4, 5 be equipped with a shaft encoder (not shown) that will record and control the transverse movement of one or the other of carriages 408, 508, and hence of the transverse disposition of print heads 422, 522. Such transverse disposition, just as the longitudinal disposition, can be controlled to "half-line" (or "half-dot separation") scale, i.e., to within 1.67 mil, hence the resolution of the resulting image—and indeed the "matching" of images along the line of abutment B–B' as between the images of first and third print regions 602, 606, or of second and fourth print regions 604, 608—can again be controlled more finely than is the resolution of print head 422 or 522. Within each of first, . . . , fourth print regions 602, . . . , 608, or any other arbitrarily selected print region, (1) a first printing is carried out at a 300 (transverse)×600 (longitudinal DPI resolution employing 1.67 mil "half-line" longitudinal steps; (2) one or the other of carriages 408, 508 (as in used in the particular embodiment of the invention) is moved transversely by 1.67 mil; and (3) a second printing at the same 300×600 DPI resolution is then conducted in which the dots produced are placed in between the dots transferred in the first printing so as to yield "half-dot" transverse resolution as well.

The dot size is changed similarly, by employing an appropriately programmed print controller to alter the time or modulation of each heating pulse for a thermal transfer print head, and similarly for other type print heads. A first set of alternating dots derived from alternating print data (using all of th elements of the print head) is printed as required by the image data along one line, carriage 408 or 508 is moved transversely by 1.67 mil as just stated, and then the intervening set of dots is printed from the intervening print data as the image may require. That process is then repeated for subsequent longitudinal lines (or half-lines) as controlled by longitudinal substrate movement. Such higher resolution printing, which is particularly useful in, e.g., printing transparencies that are to be projected to a much larger scale visual image, can if desired be a special purpose option that is selectable through the print controller, and involves both (1) programming of the carriage and substrate movement as indicated and (2) separation of the entirety of the image data into those two interleaved sets of data as described. Of course, with the apparatus described one may similarly program the carriage and substrate movements so as to interleave three or more sets of print data.

Returning to a more general theme, the ability provided by the invention to select a direct energy process, or one or more out of two or more ribbons (as in FIGS. 1–3) for use simultaneously or separately presents advantages in conducting general printing operations. The different choices available lie as well in the types of ribbons that can be installed. Some possible choices are shown in Table I:

TABLE I

| Embodiment | Ribbon | Description |
|---|---|---|
| 1 | #1 | Repeating series of y, m, c thermal transfer panels, each of which is 11 inches long. |
| | #2 | Black thermal transfer ribbon.<br>Use: printing up to 8.5 × 11 inch black or color print; use one or more panels of the set of y, m, c panels for highlight printing on black image printed by the ribbon.<br>Advantages: Low cost 8.5 × 11 inch black image and color image printing capability without changing ribbons.<br>Disadvantages: For printing small format color images, the portion of the large ribbon panel is wasted (smaller format ribbon could have adequately done the print job in such imaging requirements). For printing small format color print, need to have means to use the unused ribbon portions. |
| 2 | #1 | Same as #1 except each color panels are 44 inches long with sequence numbers on each portion of panels or other means to use unused portion of panels. |
| | #2 | Black thermal transfer.<br>Advantages: Low cost 8.5 × 11 inch black image and full color and highlight printing capability as in #1; unused portion of panels are likely to be longer in this embodiment and therefore may be used for the next full color or highlight color image.<br>Disadvantages: Tooling cost for longer panel is more expensive for 44 inch panels as compared to 11 inch panels; longer panels incorporated more complex ribbon marking and sensing; takes longer time to wind 44 inch panels when 11 inch color image is printed as compared to with 11 inch panels. (33 inch long panels can be used instead of 44 inch panels to reduce tooling cost). |
| 3 | #1 | Black thermal transfer. |
| | #2 | (yellow thermal transfer 1000 inch + blue thermal transfer 1000 inch) × 3 times, means to use unused portions of panels.<br>Advantages: black and black plus one of two or both highlight colors can be printed; two color image by printing with second ribbon in two passes<br>Disadvantages: full color capability is not available. |
| 4 | #1 | Black thermal transfer |
| | #2 | Repeating series of y, m, c panels each 11 inches long 100 times + 1000 inches long yellow thermal transfer or red thermal transfer highlight color with means to use unused portions of ribbons.<br>Advantage: The second ribbon can image one color highlight printing on a printed document printed by first ribbon or on blank paper; low cost black imaging and color imaging capability; black and full color imaging inserted |

TABLE I-continued

| Embodiment | Ribbon | Description |
|---|---|---|
| | | in black document capability.<br>Disadvantage: Yellow or y, m, c set of panels may remain unused and wasted when the other panel is used up and therefore the ribbon is replaced. |
| 5 | #1 | Repeating series of y, m, c thermal transfer ribbon each panel is 11 inch long. |
| | #2 | Repeating series of y, m, c Dye Diffusion Thermal Transfer type ribbon each panel is 11 inches long.<br>Advantage: Two types of ribbon are available to print at any time to give flexibility of printing without having to manually change the ribbons for thermal transfer printing or Dye Diffusion gray scale high quality printing.<br>Disadvantage: Black ribbon is not installed and therefore black printing by the y, m, c panels is more expensive and takes more print time. |
| 6 | #1 | Repeating series of precoat, black thermal transfer panels each 200 inches long with means to use unused portions of panels |
| | #2 | Repeating series of y, m, c thermal transfer panels each 11 inches long.<br>Advantage: precoat and/or black can be printed by first ribbon before the paper comes in front of second ribbon for color or highlight printing; precoat and black panels are not automatically wasted when y, m, c ribbon is used up.<br>Disadvantage: Precoat or black panels may remain unused and wasted when the other panel of the same ribbon is used up and therefore the ribbon is replaced. |
| 7 | #1 | Repeating series of precoat, y, m, c thermal transfer ribbon each panel is 11 inches long. |
| | #2 | Repeating series of y, m, c thermal transfer ribbon.<br>Advantage: either printing on smooth paper without precoat or on rough surface with precoat can be printed; ribbon with precoat panel is used only when printing on rough surfaces.<br>Disadvantage: Black image printing requires printing with all y, m, c panels and therefore is costly, highlight printing is expensive. |
| 8 | #1 | Precoat ribbon. |
| | #2 | (Repeating series of y, m, c thermal transfer series 30 panels + 1000 inch black thermal transfer) × 3 times with means to use unused portion of ribbon.<br>Advantage: The paper can be printed with a precoat layer by 1st ribbon and then the second ribbon can print the colors and/or black image over precoat layer, inexpensive precoat roll of ribbon; precoat layer is used only when required.<br>Disadvantages: Printing of color after black or vice versa image document requires winding the ribbon until the required other panels are brought in front of the print head ready for printing and this takes longer time for printing thus this embodiment is more effective when there is a batch of print jobs which are all black or full color. |
| 9 | #1 | Black thermal transfer. |
| | #2 | Multi-print type 200 inch long panel of a highlight color such as yellow and set of 100 11" long y, m, c panels, with means to use the unused portions of panels.<br>Advantages: Low cost black, full color capability, low cost highlight printing, low cost color highlight alphanumeric printing.<br>Disadvantage: Multi print ribbon may not print consistent high quality printing. |
| 10 | #1 | Repeating series of y, m, c thermal transfer ribbon for dot modulation. |
| | #2 | Repeating series of y, m, c thermal transfer ribbon for 1 fixed size dot printing.<br>Advantage: Higher quality color printing with many gray levels is possible as well as fixed size dot printing for less data.<br>Disadvantage: Black printing is expensive. |
| 11 | #1 | No ribbon on one side so that special coated paper can be printed with direct thermal printing. |
| | #2 | Repeating series of 11" long y, m, c thermal transfer panels.<br>Advantages: Direct printing is possible for special coated paper.<br>Disadvantage: Direct coating does not print on plain paper. |
| 12 | #1 | 8.5 inch wide thermal transfer ribbon which comprises 0.5 inch wide thermal transfer magnetic ink for character recognition and rest of the panel with black color. |
| | #2 | 8.0 inch wide conventional ribbon y, m, c thermal transfer (repeating 11 inch panels).<br>Advantages: Documents like checks can be printed in one pass both magnetic as well as black printing in the selected area.<br>Disadvantages: Magnetic ink coating is wasted when image does not require magnetic coating. |
| 13 | #1 | Black Thermal Transfer ribbon. |
| | #2 | Blue Thermal Transfer<br>Advantages: Black or Blue image as well as Black and Blue image can be printed.<br>Disadvantage: Full color printing is not possible. |
| 14 | #1 | Replenishing type black thermal transfer ribbon. |
| | #2 | Repeating series of y, m, c thermal transfer panels of 11 inches long.<br>Advantages: Low cost black printing because the thermal transfer layer can |

TABLE I-continued

| Embodiment | Ribbon | Description |
|---|---|---|
| | | be replenished.<br>Disadvantages: Printer is more costly due to the cost for replenishing ink sub-system. |
| 15 | #1 | Black thermal transfer ribbon. |
| | #2 | Repeating series of y, m, c thermal transfer panels of 11 inches long with means to use the unused portions of panels.<br>Advantages: Black, full color letter size and small format color image can be printed economically.<br>Disadvantages: Need Read Head to read sequence numbers. |
| 16 | #1 | Repeating series of y, m, c thermal transfer repeating all panels, each 4 inch wide panel is 5 inches long. |
| | #2 | 8.5 inch wide thermal transfer ribbon.<br>Use: printing up to 8.5 × 11 inch black or small format up to 5 × 4 inch color print or 8.5 × 11 inch black plus small format color inserted in black document.<br>Advantages: 4 inch print head is fixed in location, therefore hardware is less expensive than #17, small format color imaging capability, lower cost than 8.5 × 11 inch color print, since the print head is only 4 inches wide, hardware cost is lower than that for 8.5 inch wide print head<br>Disadvantages: Large size 8.5 × 11 inch color image may have registration errors due alignment between two images is more difficult<br>Note: Longer image can be printed by printing 4 × 5 inch image first from top edge of the image and then another up to 4 × 5 image adjoining the first image's bottom edge by another set of y, m, c color panels |
| 17 | #1 | Repeating series of y, m, c thermal transfer panels, each 4 inch wide and 5 inches long; the 4 inch wide print head/ribbon assembly is mounted on carriage and can be axially moved by belt or screw |
| | #2 | 8.5 inch wide thermal transfer ribbon<br>Use: printing up to 8.5 × 11 inch black or small format up to 5 × 4 inch color print or 8.5 × 11 inch black plus small format color inserted in black document<br>Advantages: Color 5 × 4 image can be printed anywhere in the black document; since each color panel is only 5 inches long, it is simpler to sense, since the print head is only 4 inches wide hardware cost is lower than that for 8.5 inch wide print heads<br>Disadvantages: Large size 8.5 × 11 inch color image may have registration errors due alignment between two images is more difficult; hardware is more expensive than #16 because means to move the print head axially is incorporated.<br>Note: Longer image can be printed by printing 4 × 5 inch image first from top edge of the image and then another up to 4 × 5 image adjoining the first image's bottom edge by another set of y, m, c color panels |
| 18 | #1 | Repeating series of y, m, c thermal transfer repeating all panels, each 4 inch wide panel is 11 inch long; print head/ribbon assembly is mounted on carriage and can be axially moved by belt or screw. |
| | #2 | 8.5 inch wide thermal transfer ribbon.<br>Use: printing up to 4 × 11 inch image anywhere on the paper and on black image printed by another print head. Low cost black full page image;<br>Advantages: Up to 11 inch long color images can be printed; since the print head is only 4 inches wide hardware cost is lower than that for 8.5 inch wide print head<br>Disadvantages: Large size 8.5 × 11 inch color image can not be printed without stepping of carriage.<br>Note: Wider image can be printed by processing the image and printing the second image after moving the paper back to the original position after printing the first image. |
| 19 | | same as #17 except 4 inch wide ribbon panels are 11 inches long<br>Advantages: Up to 11 inch long color images can be printed anywhere on the 8.5 × 11 document; since the print head is only 4 inch wide hardware cost is lower than that for 8.5 inch wide print head<br>Disadvantages: Large size 8.5 × 11 inch color image may have registration errors due alignment between two images is more difficult; hardware is more expensive than #16 because of means to move the 5 inch print head axially is incorporated<br>Note: Wider image also can be printed by printing first 4 inch wide image from the edge of image and then printing upto another 4 inch wide image starting from the other edge |
| 20 | #1 | Precoat ribbon |
| | #2 | Yellow ribbon |
| | #3 | Magenta ribbon |
| | #4 | Cyan ribbon<br>Advantage: Printing any color or full color on special as well as plain paper at low cost.<br>Disadvantage: Need four print heads and therefore equipment is expensive |
| 21 | #1 | Yellow ribbon |
| | #2 | Magenta ribbon |
| | #3 | Cyan ribbon |

TABLE I-continued

| Embodiment | Ribbon | Description |
|---|---|---|
| | #4 | Black ribbon<br>Advantage: Low cost printing any color, full color and black<br>Disadvantage: Four head is expensive |

NOTES:
The above ribbon embodiments can be changed to optimize print job and some of the example to change are as follows:
Note #1: Embodiment #1 to #5, 9, 10, 11, 12, 13, 14, 16, 17, 18, and 19 can incorporate precoat panels in addition to y, m, c and/or black to enable printing on wider variety of plain paper.
Note #2: In embodiments 1, 2, 3, 4, 6, 7, 8, 9, 10, 11, 16, 17, 18, and 19 #2 ribbon of 12, 13, 14 and 15 Dye Diffusion Thermal Transfer or any other technology for the ribbon can be used instead of one or both ribbons of thermal transfer shown in the table.
Note #3: Panel number and portion of panels can be marked or means is provided so that unused portion of panels can be used.
Note #4: Some of the panels can incorporate magnetic ink for character recognition.
Note #5: Some of the panels can have multiprint capability to enable printing more than one print by the ribbon.
Note #6: Ribbon can be replenishing type so that a replenishing subsystem can replenish one or more ribbons.
Note #7: Marks can be on the printing area of the ribbon.

The foregoing examples should be considered to be representative only and not exhaustive since a person of ordinary skill in the art can easily conceive of other examples that may differ from those indicated in some detail but would not depart from the spirit and scope of the invention. Thus, the ribbons in any of examples one through five or nine through 15 may also incorporate additional precoat panels to permit printing on a wider variety of plain paper; and in any of examples one through four and six through 11, as also in the second ribbon of examples 12 and 13 through 15, the ribbon can be of dye diffusion or other technology instead of thermal transfer. Also, any other example may, like example five, include both thermal transfer and dye diffusion technologies. Such ribbons may also incorporate the panel marking and usage procedures previously described.

Regarding the printer structure, it will be understood that departures may be made from the precise structure shown in the figures, e.g., such that the printing assemblies are oriented at different angles. Similarly, one may use the known procedure in which an image is first transferred to a drum and is then copied onto paper (which would use one or the other paper transfer process). None of such variations as would be attainable to a person of ordinary skill in the art on the basis of the present disclosure would depart from the spirit and scope of the invention, which are to be taken only from the claims which follow, and from the equivalents thereof.

I claim:

1. A printer comprising:

a first multi-color elongate ribbon installed in the printer;

a second multi-color elongate ribbon installed in the printer;

the first and second elongate ribbons each bearing on a surface thereof two or more panels of transfer material adapted to transfer an image onto a substrate;

first and second print heads each disposed in cooperation with a corresponding one of the first and second ribbons, respectively, for selectively transferring an image onto the substrate;

means for applying a first application of energy from the first print head to the first ribbon transfer material according to a first predetermined set of operating parameters for transferring an image from the first ribbon to the substrate; and means for applying a second application of energy from the second print head to the second ribbon transfer material according to a second predetermined set of operating parameters for transferring an image from the second ribbon to the substrate;

wherein the first ribbon transfer material comprises, in combination, an ink, means for releasing the ink, and means for adhering the ink to the substrate in a thermal transfer process; and the second ribbon transfer material comprises a dye diffusion type of transfer material different from the first transfer material for transferring the image to the substrate using a sublimation transfer process so that two different types of ribbons are available on demand for printing in a single non-impact printer.

2. A printer according to claim 1 wherein each of the first and second print heads and the corresponding ribbons are sized and arranged for selectively printing over substantially an entire surface of the substrate, whereby the printer can provide a wide variety of printing tasks including mixing different transfer materials over substantially the entire surface of the substrate without changing ribbons.

3. A printer according to claim 1 further comprising substrate handling means for conveying the substrate between a first predetermined position for receiving the image transferred by the first print head and a second predetermined position or receiving the image transferred by the second print head, while maintaining alignment of the substrate relative to the first and second print heads.

4. A printer according to claim 1 wherein each of the first and second ribbons comprises a repeating series of panels, each series comprising at least two different colored panels of transfer material, thereby allowing color printing using different transfer materials within the single printer without changing ribbons.

5. A printer according to claim 1 wherein the first ribbon transfer material is formed to receive repeated applications of energy for transfer of multiple images to the substrate while the second ribbon transfer material is formed to receive only a single application of energy for transfer of a single image.

6. A printer according to claim 1 wherein each of the ribbons includes repeating panels of yellow, magenta and cyan color transfer material.

7. A printer according to claim 1 wherein one of the ribbon's transfer material is formed to receive repeated applications of energy for transfer of multiple images to the substrate while the other ribbon's transfer material is formed to receive only a single application of energy for transfer of a single image to the substrate.

* * * * *